US005261381A

United States Patent [19]

Sugiura et al.

[11] Patent Number: 5,261,381

[45] Date of Patent: Nov. 16, 1993

[54] IGNITION COIL UNIT FOR INTERNAL COMBUSTION ENGINE

[75] Inventors: Akimitsu Sugiura, Takahama; Satoru Murate, Okazaki, both of Japan

[73] Assignee: Nippondenso Co., Ltd., Kariya, Japan

[21] Appl. No.: 866,064

[22] Filed: Apr. 10, 1992

[30] Foreign Application Priority Data

Apr. 10, 1991 [JP] Japan ..... 3-77607

[51] Int. Cl.[5] ..... F02P 3/02; H01F 15/02

[52] U.S. Cl. ..... 123/634; 123/635; 336/96

[58] Field of Search ..... 123/634, 635, 647; 336/96

[56] References Cited

U.S. PATENT DOCUMENTS

| | | | |
|---|---|---|---|
| 4,627,407 | 12/1986 | Betz | 123/634 |
| 4,658,799 | 4/1987 | Kusaka et al. | 123/634 |
| 4,706,638 | 11/1987 | Johansson et al. | 123/635 |
| 4,763,094 | 8/1988 | Kojima | 336/92 |
| 4,834,056 | 5/1989 | Kowai | 123/634 |
| 4,843,362 | 6/1989 | Heritier-Best | 336/96 |
| 4,903,674 | 2/1990 | Bassett et al. | 123/635 |
| 4,986,249 | 1/1991 | Nakamura | 123/635 |
| 4,989,575 | 2/1991 | Kanno | 123/635 |
| 5,109,209 | 4/1992 | Ida et al. | 336/96 |

FOREIGN PATENT DOCUMENTS

| | | |
|---|---|---|
| 0387993 | 9/1990 | European Pat. Off. . |
| 0458755 | 11/1991 | European Pat. Off. . |
| 3830329 | 5/1989 | Fed. Rep. of Germany . |
| 8500930 | 2/1985 | PCT Int'l Appl. . |
| 2173047 | 10/1986 | United Kingdom . |

OTHER PUBLICATIONS

Journal of Nippondenso Technical Disclosure, No. 75-017, Nov. 15, 1990.

*Primary Examiner*—Willis R. Wolfe

*Attorney, Agent, or Firm*—Cushman, Darby & Cushman

[57] ABSTRACT

An ignition coil unit which is capable of mounting in a relatively small space between opposed cylinder head covers of an internal combustion engine is disclosed, wherein a pair of separate coil assemblies received in a single insulating-resin case is firmly embedded in the case by a cured casting resin such as a thermosetting resin filled in the case in such a manner that the pair of coil assemblies can be directly connected to each pair of adjacent spark plugs provided one for each cylinder of the internal combustion engine.

13 Claims, 9 Drawing Sheets

IGNITION COIL UNIT FOR INTERNAL COMBUSTION ENGINE

BACKGROUND OF THE INVENTION

1. Field of the Invention:

The present invention relates to an ignition coil unit having at least one coil assembly directly connected to each spark plug provided for one of a plurality of cylinders of an internal combustion engine.

2. Description of the Prior Art:

There has been known an ignition system in which one ignition coil unit is provided for each of a plurality of cylinders of an internal combustion engine and directly connected to a spark plug of each respective cylinder (e.g., Journal of Nippondenso Technical Disclosure No. 75-017, published Nov. 15, 1990).

In recent years, attempts have been made to mount such an ignition system in a compact and small-displacement internal combustion engine, but no one was successful because the compact and small-displacement internal combustion engine can only provide a small space between opposed cylinder head covers, which space is insufficient to allow installation of the ignition coil unit.

SUMMARY OF THE INVENTION

With the foregoing drawbacks of the prior art in view, it is an object of the present invention to provide an ignition coil unit which can be mounted in a relatively small space defined between opposed cylinder head covers of an internal combustion engine for separately igniting two adjacent ones of a plurality of spark plugs each provided for one cylinder of the internal combustion engine.

According to a first aspect of the present invention, there is provided an ignition coil unit for being directly connected to two adjacent ones of a plurality of spark plugs each provided for one of a plurality of cylinders of an internal combustion engine, which comprises: a case formed from an insulating resin and having two tubular portions integrally formed with the case; two coil assemblies received in the case; and a cured casing resin filled in the case for sealing and setting the coil assemblies in the case.

Preferably, the two coil assemblies are disposed in the case in longitudinal alignment with each other. The ignition coil unit further has a pair of mounting legs formed integrally with opposite longitudinal ends of the case, respectively, for directly mounting the ignition coil unit in the internal combustion engine, and a pair of high-tension terminals disposed in the tubular portions, respectively, for supplying a high voltage from the coil assemblies to the spark plugs. The sum of the length of the case excluding the mounting legs and the length of one of the mounting legs is less than or equal to twice the distance between the pair of high-tension terminals.

According to a second aspect of the present invention, there is provided an ignition coil unit for being directly connected to two adjacent ones of a plurality of spark plugs each provided for one of a plurality of cylinders of an internal combustion engine, the ignition coil unit comprising: a pair of coil assemblies each including a closed magnetic circuit core and a primary coil and a secondary coil that are magnetically connected with each other via the closed magnetic circuit core; a case made from an insulating resin and receiving therein the pair of coil assemblies in longitudinally aligned relation, the case including a pair of bulged portions formed integrally with opposite longitudinal end portions of the case, a pair of tubular portions contiguous to forward ends of the bulged portions, respectively, and confronting to the two adjacent spark plugs, and a shallow-bottom portion provided at a central portion of the case and retaining thereon the closed magnetic circuit core; a pair of high-tension terminals mounted in the tubular portions, respectively, and electrically connected to respective high-tension sides of the secondary coils within the bulged portions; and a cured casing resin filled in the case for sealing and setting the coil assemblies in the case.

The above and other objects, features and advantages of the present invention will become more apparent from the following description when making reference to the detailed description and the accompanying sheets of drawings in which preferred structural embodiments incorporating the principles of the present invention are shown by way of illustrative example.

DETAILED DESCRIPTION OF THE INVENTION

The present invention will be described hereinbelow in greater detail with reference to certain preferred embodiments shown in the accompanying drawings.

Figure 1:
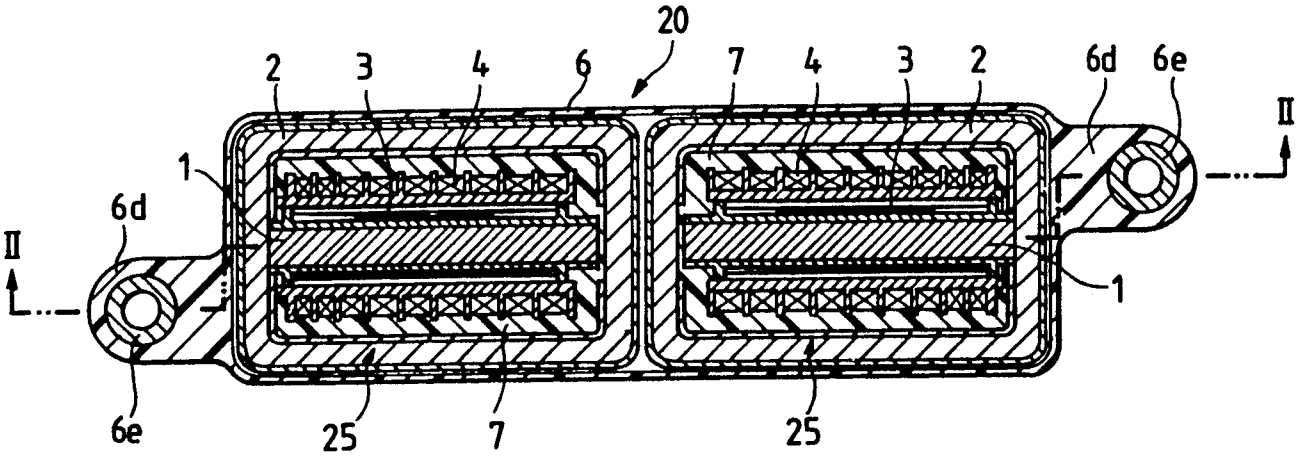
FIG. 1 is a cross-sectional view of an ignition coil unit according to an embodiment of this invention.
Figure 2:
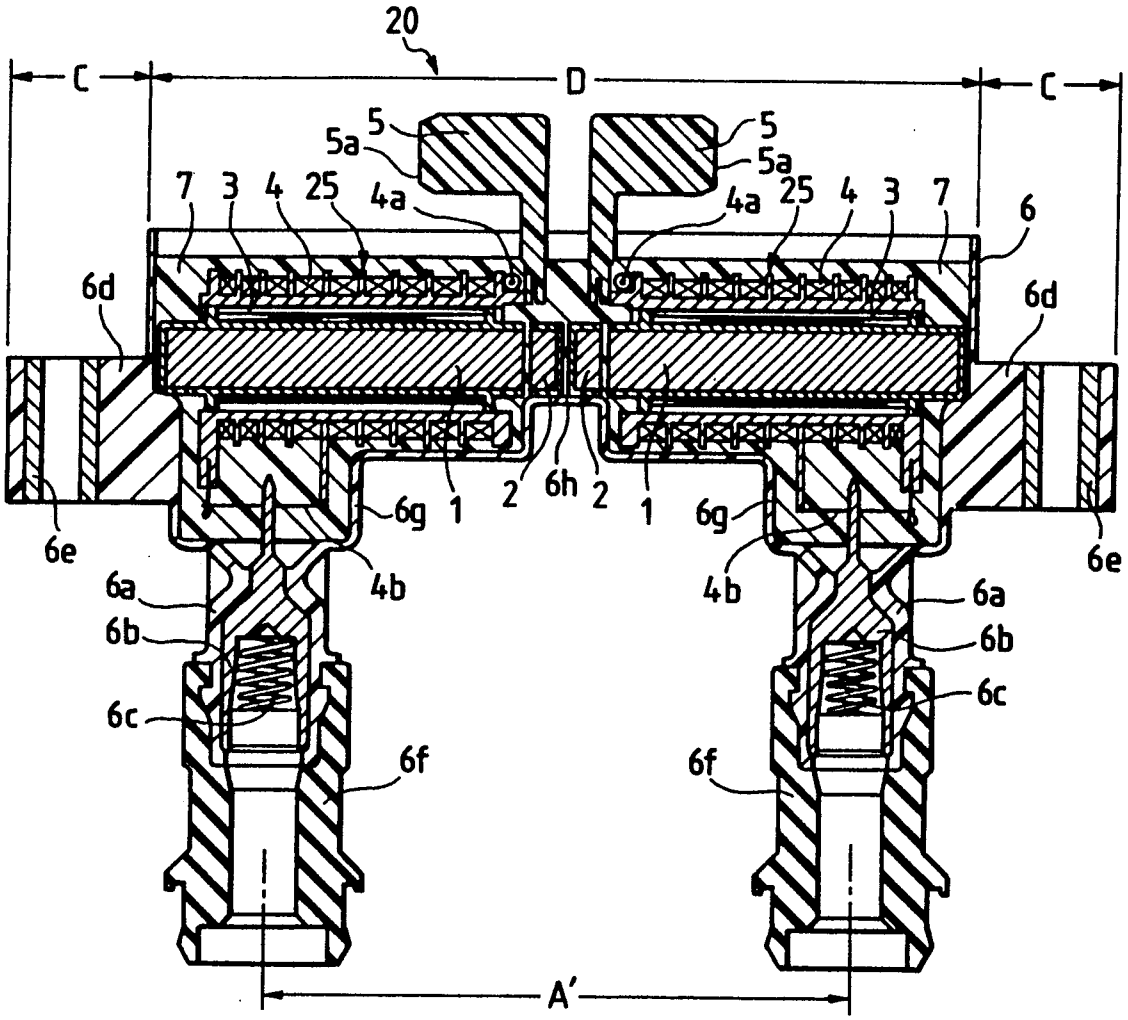
FIG. 2 is a cross-sectional view taken along line II—II of FIG. 1.

FIGS. 1 and 2 show in cross section an ignition coil unit 20 according to one embodiment of this invention.

The ignition coil unit 20 includes a pair of coil assemblies 25 each composed of a closed magnetic circuit formed jointly by an I-shaped core 1 and an O-shaped core 2, and a primary coil 3 and a secondary coil 4 that are wound concentrically on the I-shaped core 1. Opposite ends of the primary coil 3 are connected to a primary connector 5 (FIG. 2). The secondary coil 4 is connected at its low-tension side to an ON-state voltage blocking diode **4*a* (FIG. 2). The high-tension side of the secondary coil 4 is electrically connected to a connecting terminal 4*b* disposed below the secondary coil 4**.

The pair of coil assemblies 25 of the foregoing construction are received in an elongate case 6 in alignment with each other in the longitudinal direction of the I-shaped cores 1. The case 6 is formed from an insulating resin. The coil assemblies 25 are sealed and set in the insulating-resin case 6 by means of a cured casing resin 7 such as a thermosetting resin filled in the insulating-resin case 6. As shown in FIG. 2, the elongate insulating-resin case 6 includes a pair of bulged portions 6g, 6g projecting downwardly from opposite longitudinal end portions of the bottom wall of the case 6 for receiving therein the connecting terminals 4b, respectively, and a pair of tubular portions 6a, 6a formed integrally and extending downwardly from lower ends of the respective bulged portions 6g and 6g. A pair of cup-shaped high-tension terminals 6b, 6b is firmly mounted in the tubular portions 6a, 6a, respectively, by integral molding, for example. The bottom wall of the case 6 includes a shallow central portion 6h in the form of a projection on which one end of the O-shaped cores 2 is retained.

Each of the high-tension terminals 6b is electrically connected by the connecting terminal 4b to the high-tension side of the corresponding secondary coil 4 and receives therein a compression coil spring 6c electrically connected to each of a plurality of spark plugs 10 (FIG. 4) of an internal combustion engine E. The elongate insulating-resin case 6 includes a pair of mounting legs 6d, 6d formed integrally with opposite ends of the case 6 for mounting the ignition coil unit in an internal combustion engine E. Each of the mounting legs 6d includes a metal sleeve or bushing 6e firmly embedded therein by the integral molding, for example. A rubber boot 6f is fitted with a forward end of each of the tubular portions 6a.

The ignition coil unit 20 of the foregoing construction is dimensioned as follows. Assuming that the distance (pitch) between the high-tension terminals 6b is given by A', the length of a body of the ignition coil unit excluding the mounting legs 6e is given by D, and the length of each mounting leg 6e is given by C as shown in FIG. 2, these dimensions A', D and C are related so that $$D+C \leqq 2A'. \quad (1).$$

Since the pitch A' of the adjacent high-tension terminals 6b is equal to the pitch A (FIG. 4) of the adjacent spark plugs 10, we can obtain $$D+C \leqq 2A. \quad (2).$$

Figure 3:
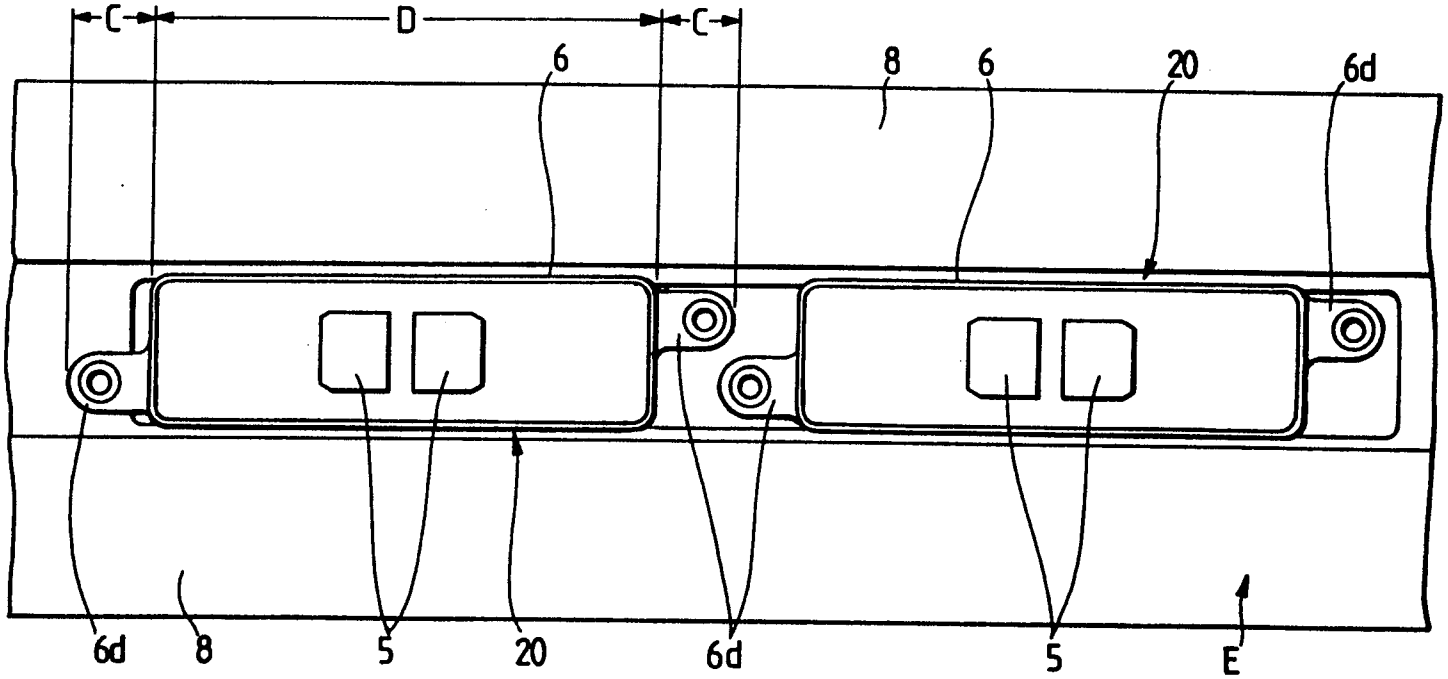
FIG. 3 is a plan view showing the manner in which two ignition coil units according to this invention are mounted in an internal combustion engine.
Figure 4:
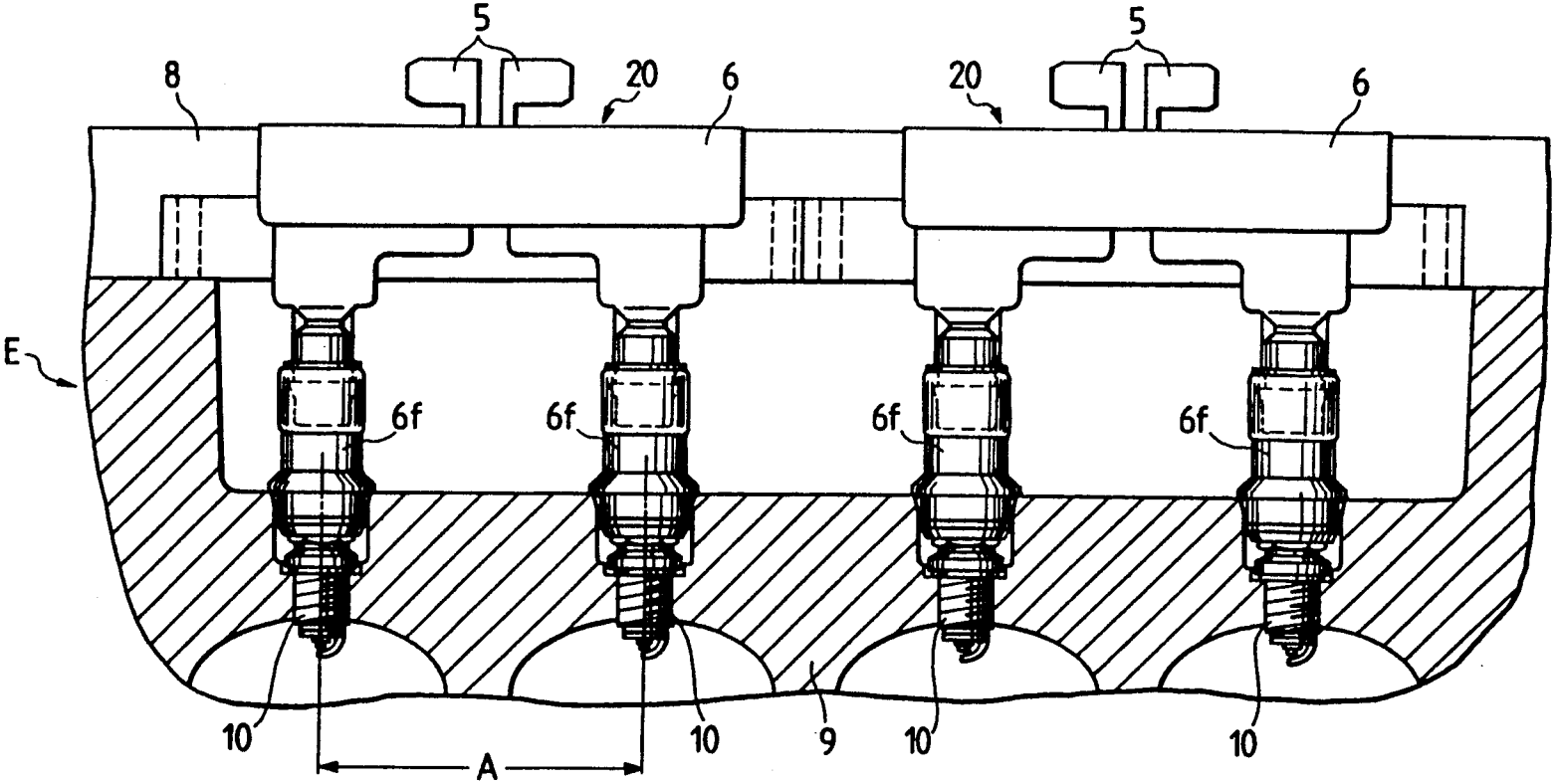
FIG. 4 is a front elevational view, partly in cross section, of FIG. 3.
Figure 7:
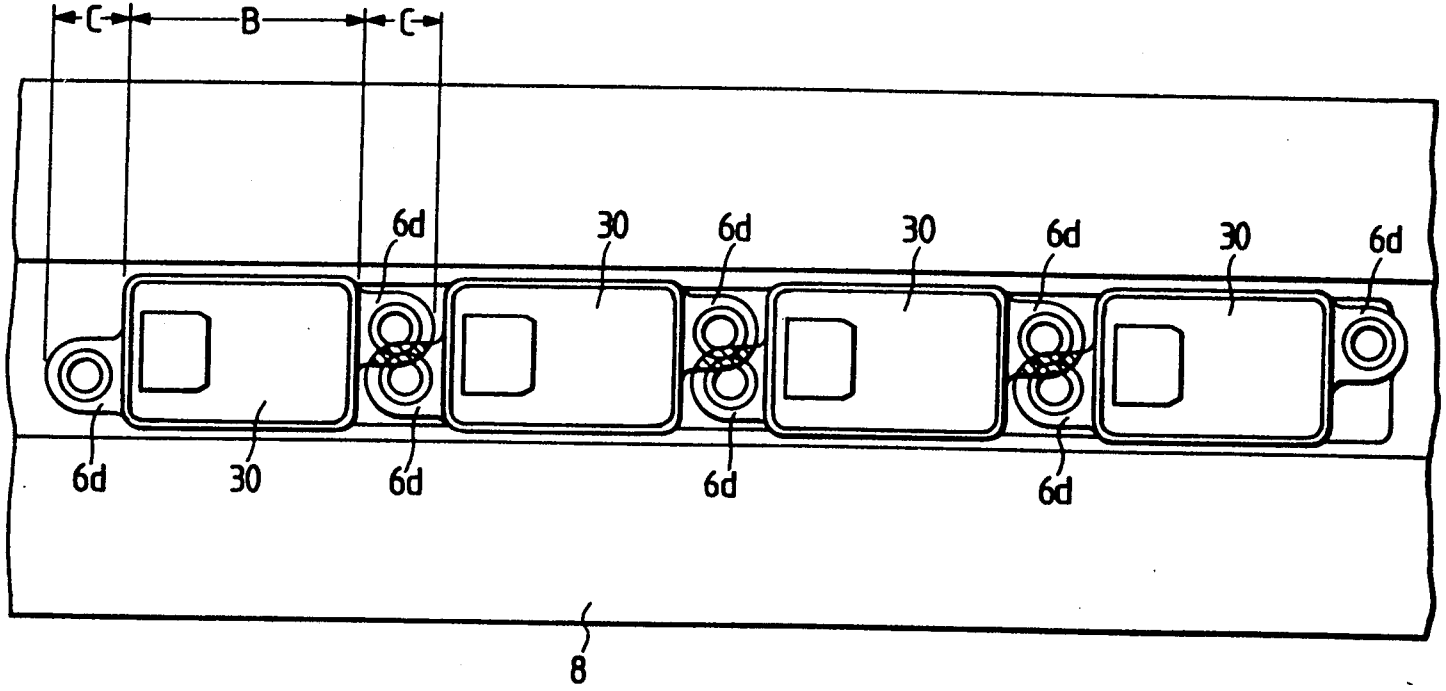
FIG. 7 PRIOR ART
FIG. 7 is a plan view showing the manner in which conventional ignition coil units are mounted in an internal combustion engine.
Figure 8:
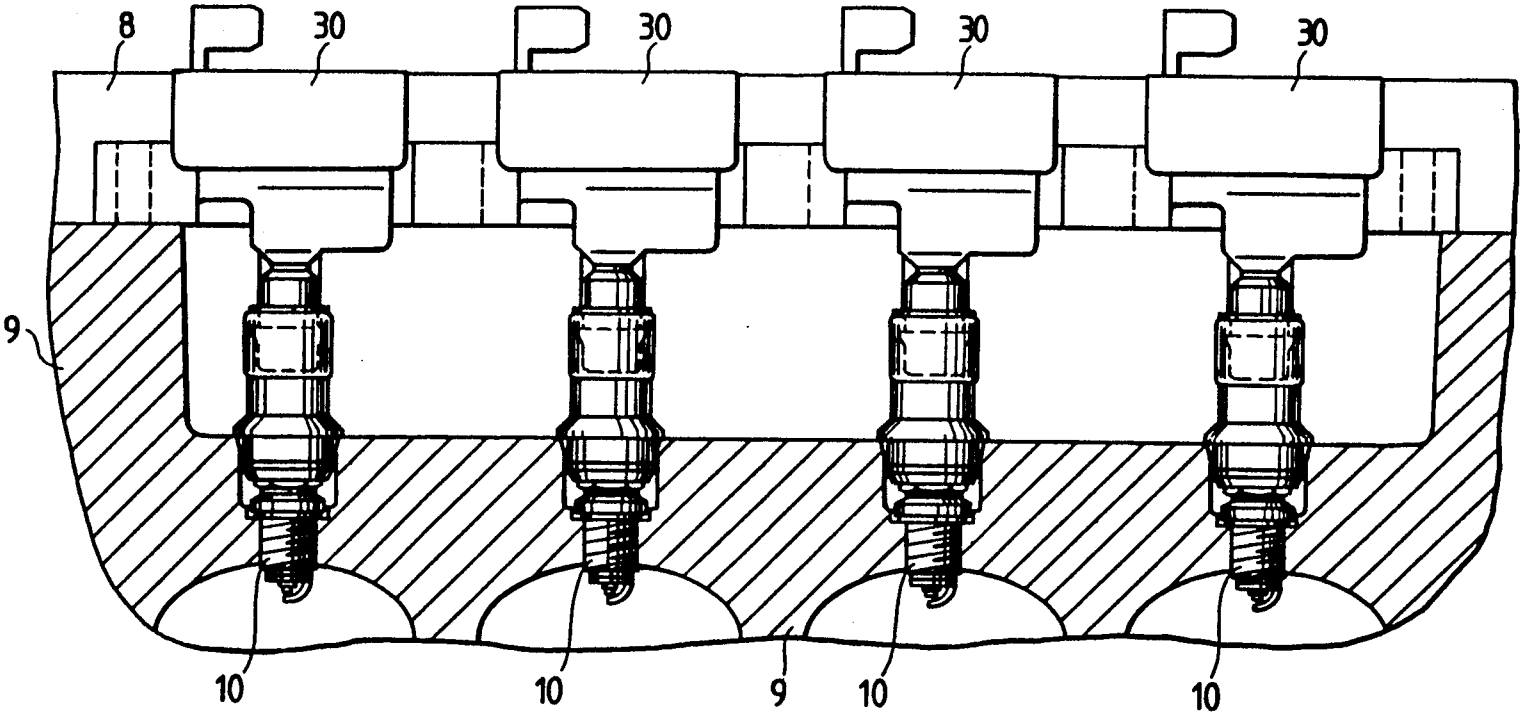
FIG. 8 PRIOR ART
FIG. 8 is a front elevational view, partly in cross section, of FIG. 7.

As shown in FIGS. 7 and 8, when a plurality of conventional ignition coil units 30 each having only one ignition coil assembly provided for each cylinder are to be mounted in a small space defined in a head cover 8 of a cylinder head 9, mounting legs 6d of two adjacent ones of the ignition coil units 30 interfere with each other at a portion indicated by hatching in FIG. 7 and, hence, mounting of the conventional ignition coil units 30 is practically impossible. In the case of the ignition coil unit 20 of the present invention, an extent of each ignition coil unit 20 in the longitudinal direction of a crankshaft (i.e., the length of the ignition coil unit) is smaller than a combined length of two adjacent ones of the conventional ignition coil units 30 by at least a distance which is equal to the length of one mounting leg 6d. With this dimensional reduction, the ignition coil units 20 having the same number of coil assemblies 25 as the cylinders can neatly be mounted in a small space defined in opposed head covers 8 of the cylinder head 9, as shown in FIGS. 3 and 4.

Figure 9:
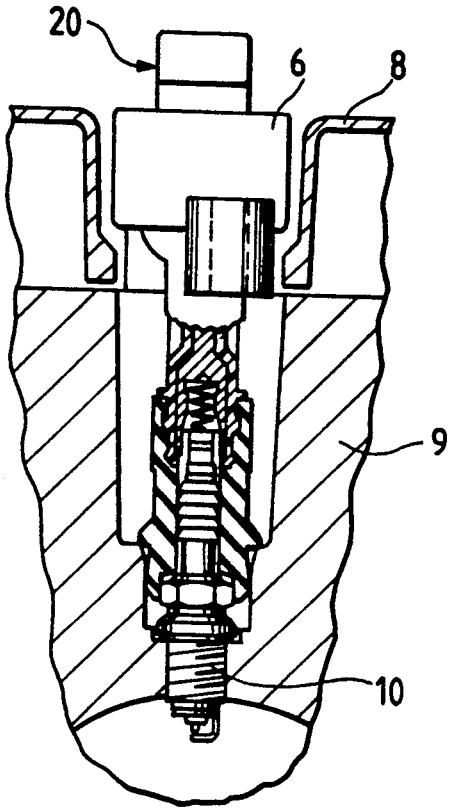
FIG. 9 is a side view, partly in cross section, of the ignition coil unit mounted in the internal combustion engine.

The relation between particular longitudinal dimensions of the ignition coil unit and the pitch A of the spark plugs 10 will be described below in greater detail. In this instance, the width of the ignition coil unit is smaller than the distance between opposed head covers 8 of an internal combustion engine to be mounted in, so that the ignition coil unit can be received between the head covers 8, as shown in FIG. 9. In the case of the conventional ignition coil units 30 such as shown in FIG. 7, an internal combustion engine in which the ignition coil units 30 are to be mounted has a pitch A of spark plugs which is smaller than the sum of the length B of the body of each ignition coil unit 30 and the length of the mounting legs 6d, that is $$\text{if } A<B+C, \quad (3)$$

then, mounting of the ignition coil units 30 relative to the engine is not possible due to interference between the adjacent mounting legs 6d.

Figure 5:
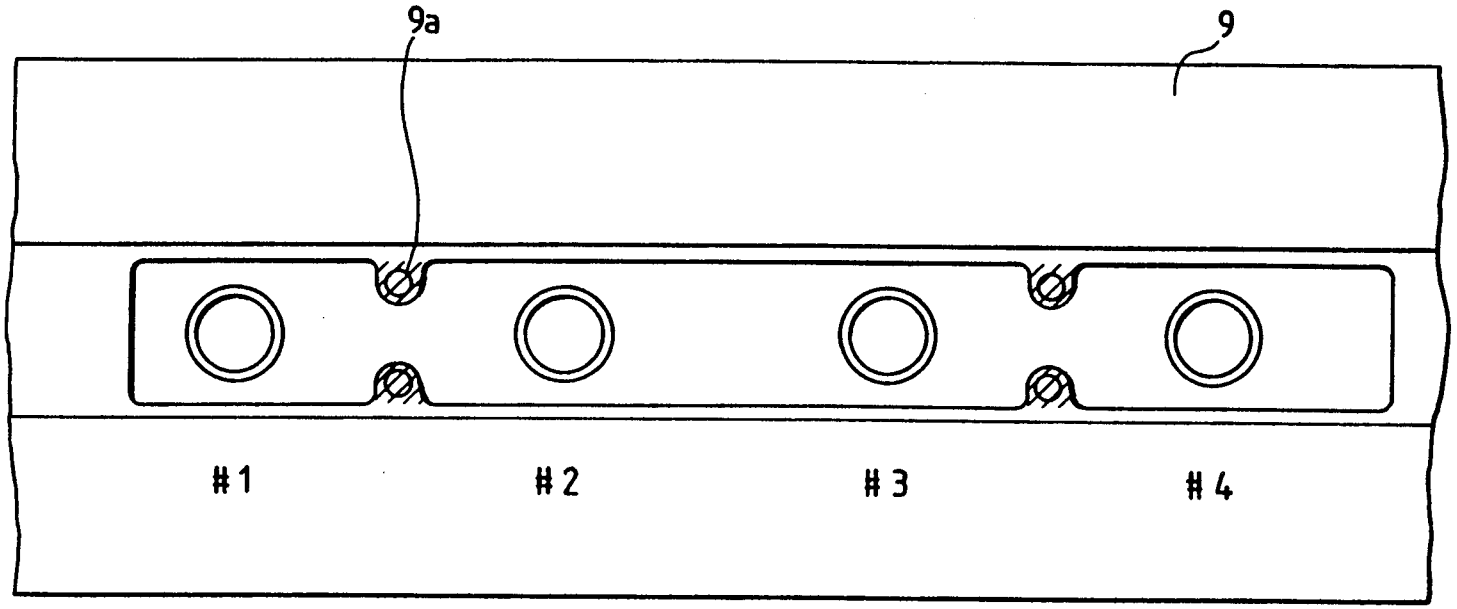
FIG. 5 is a plan view showing a cylinder head of the internal combustion engine.
Figure 6:
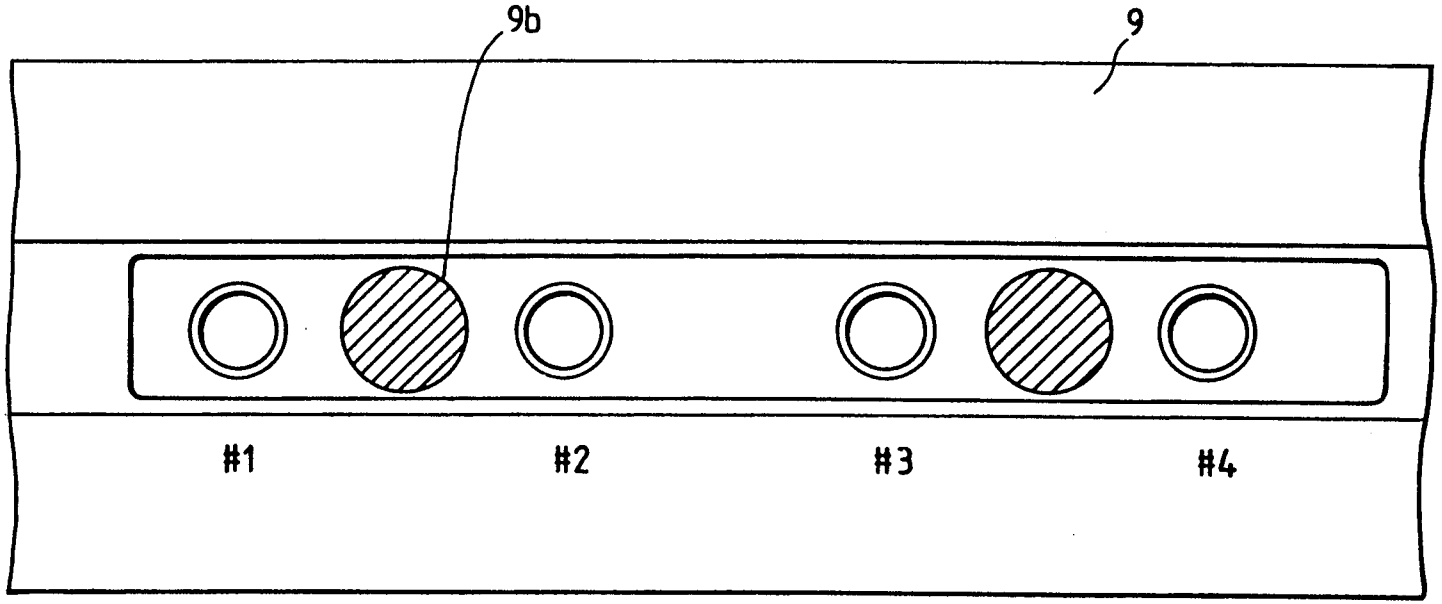
FIG. 6 is a plan view showing another cylinder head.

In the case of a four-cylinder engine, for example, the cylinder head 9 includes two pairs of head cover mounting portions 9a provided respectively between first and second cylinders and between third and fourth cylinders, as indicated by hatching in FIG. 5. As an alternative, the cylinder head 9 may have two holes 9b formed by a sand mold at the time when the cylinder head 9 is molded, as indicated by hatching in FIG. 6. Therefore, it occurs likely that a sufficient space for the mounting of ignition coil units cannot be provided on the cylinder head 9.

The ignition coil unit 20 of this invention has a body whose length D is twice the length B of the body of the conventional ignition coil unit 30 as it correspond in function to two of the conventional ignition coil units 30. That is D=2B.

Substitution of these values into the expression (2) gives $$2B+C \leqq 2A.$$

Thus, $A \geqq B+C/2$.

This means that the ignition coil unit 20 of this invention can be mounted in an internal combustion engine with a spark pug pitch A which is greater than or equal to the (B+C/2) value. Accordingly, by using the construction of this invention, the maximum allowable range provided for mounting the conventional ignition coil unit 30 relative to the spark plug pitch A, such as indicated by the expression (3), can be extended to a certain extent as indicated by the following expression, without deteriorating the performance characteristics of the ignition coil units.

$$B+C/2 \leqq A \leqq B+C.$$

In addition, when the ignition coil units 20 of this invention are mounted in the four-cylinder engine, they do not require any space at a position between first and second cylinders or between third and fourth cylinders when the ignition coil units 20 are mounted directly on the cylinder head 9. Thus, the ignition coil units 30 can be mounted directly onto a cylinder head 9 even when the cylinder head 9 does not have enough space at the corresponding portions due to the reasons as set forth above with reference to FIGS. 5 and 6.

As described above, each of the ignition coil units 20 of this invention includes two coil assemblies 25. Each of the coil assemblies 25 is composed of a secondary coil 4 having a connecting terminal 4b disposed below a high-tension side thereof, a primary coil 3 engaged concentrically with the secondary coil 4, a primary connector 5 disposed at an end of the primary coil 3 adjacent to a low-tension side of the secondary coil 4 and having an engagement portion 5a (FIG. 2) directed in the longitudinal direction of the primary coil 3 toward the opposite end of the primary coil 3, first and second cores 1 and 2 jointly forming a closed magnetic circuit, and an ON-state voltage blocking diode 4a connected to the low-tension side of the secondary coil 4. The two coil assemblies 25 are received in the insulating-resin case 6 in longitudinal alignment with each other and in opposite relation to one another, with the low-tension sides of the respective secondary coils 4 disposed close to one another.

With this arrangement, since the engagement portions 5a of the respective primary connectors 5 lie horizontally at the central portion of the ignition coil unit 20 and directed in opposite directions (away from one another), the primary connectors 5 can easily be coupled with mating connectors (not shown) provided at the vehicle side and is able to lower the overall height of a wiring structure of the vehicle side including the connection between the primary connectors 5 the vehicle side connectors.

In addition, the high-tension sides of the respective secondary coils 4 are disposed directly above the corresponding high-tension terminals 6b disposed within the case 4 at the same pitch as the pitch of the spark plugs 10 of an internal combustion engine in which the ignition coil units 20 are to be assembled. The connecting terminals 4b disposed below the secondary coils 4 are relatively compact (i.e., an extent of the connecting terminals 4b in the axial direction of the coil assemblies 25 is relatively small.)

In the embodiment described above, the closed magnetic circuit formed by the first and second cores 1 and 2 is a generally Φ shape, however, an O-shaped closed magnetic circuit may be used. In addition, a part of the cores 1 and 2 may be integrally molded with the insulating-resin case 6. Further, it is possible to join two adjacent O-shaped cores 2 end to end into a unitary construction. Yet, a part of the closed magnetic circuit may be formed by using a permanent magnet.

In the illustrated embodiment, the two coil assemblies 25 are received in one insulating-resin case 6 in opposite positional relation or orientation in respect of the longitudinal direction of the ignition coil unit 20, however, they may be disposed in the same orientation.

In addition, while in the illustrated embodiment, the mounting legs 6d of each ignition coil unit 20 are displaced in opposite directions with respect to a longitudinal central axis of the ignition coil unit 20, they may be either displaced in the same direction with respect to the longitudinal central axis of the ignition coil unit 20, or alternatively aligned with the longitudinal central axis of the ignition coil unit 20.

Figure 10:
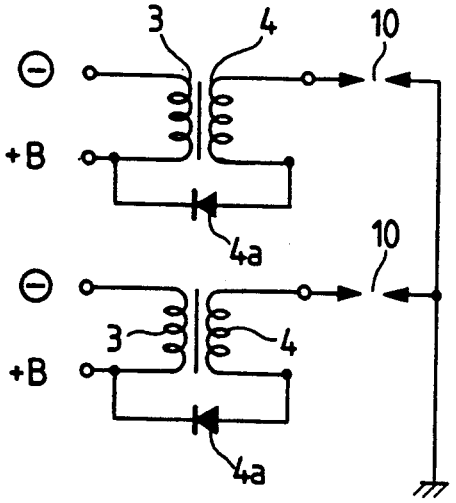
FIG. 10 is an electric circuit diagram showing the connection between components of the ignition coil unit.
Figure 11:
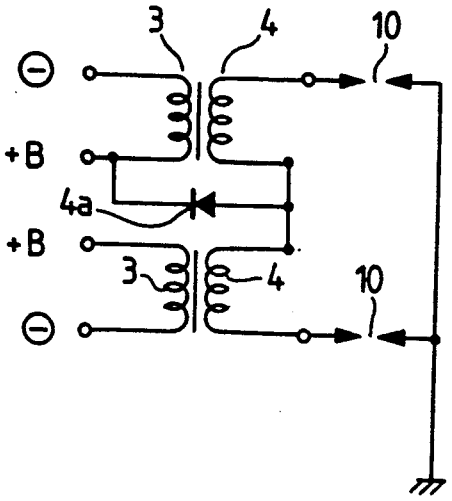
FIG. 11 is an electric circuit diagram showing a modified form of the connection in the ignition coil unit.

FIG. 10 is a circuit diagram of the ignition coil unit shown in FIGS. 1 and 2. As shown in FIG. 10, each of the ON-state voltage blocking diodes 4a is connected between the low-tension side of one of the secondary coils 4 and a power supply terminal +B of one of the primary coils 3 in order to protect a corresponding one of the spark plugs 10 against a voltage generated at the secondary coil 4 when a primary current is caused to flow through the primary coil 3. The two ON-state voltage blocking diodes 4a may be replaced by only one ON-state voltage blocking diode 4a, as shown in FIG. 11. In this case, a power supply terminal +B of one of the two primary coils 3 is connected to an anode of the ON-state voltage blocking diode 4a, while a cathode of the diode 4a is connected to a junction between the low-tension sides of the respective secondary coils 4. Sine each of the ignition coil units 20 have two coil assemblies 25, the use of a single diode 4a makes it possible to connect the secondary coils 4 of the two coil assemblies 25 with utmost ease.

As described above, an ignition coil unit according to this invention includes an insulating-resin case having a pair of tubular portions confronting to each pair of adjacent spark plugs, a pair of coil assemblies received in the case, and a cured casting resin filled in the case for sealing and setting the coil assemblies in the case. The ignition coil unit thus constructed is compact as a whole and can be mounted in a relatively small space between opposed cylinder head covers of an internal combustion engine.

Obviously, various minor changes and modifications of the present invention are possible in the light of the above teaching. It is therefore to be understood that within the scope of the appended claims the invention may be practiced otherwise than as specifically described.

What is claimed is:

1. An ignition coil unit for being directly connected to two adjacent ones of a plurality of spark plugs each provided for one of a plurality of cylinders of an internal combustion engine, comprising:

a case formed from an insulating resin and having two tubular portions integrally formed with said case;

two coil assemblies received in said case;

a cured casing resin filled in each case for sealing and setting said coil assemblies in said case; and wherein said two coil assemblies are disposed in said case in longitudinal alignment with each other, said ignition coil unit further has a pair of mounting legs formed integrally with opposite longitudinal ends of said case, respectively, for directly mounting said ignition coil unit in the internal combustion engine, and a pair of high-tension terminals disposed in said tubular portions, respectively, for supplying a high voltage from said coil assemblies to the spark plugs, and the sum of the length of said case excluding said mounting legs and the length of one of said mounting legs is less than or equal to twice the distance between said pair of high-tension terminals.

2. An ignition coil unit according to claim 1, wherein said mounting legs are displaced in different directions with respect to a longitudinal central axis of said case.

3. An ignition coil unit for being directly connected to two adjacent ones of a plurality of spark plugs each provided for one of a plurality of cylinders of an internal combustion engine, comprising:

a case formed from an insulating resin and having two tubular portions integrally formed with said case;

two coil assemblies received in said case;

a cured casing resin filled in each case for sealing and setting said coil assemblies in said case; and a pair of primary connectors disposed at a central portion of said case and having a pair of engagement portions, respectively, said engagement portions being directed away from one another and opening in a longitudinal direction of said case.

4. An ignition coil unit for being directly connected to two adjacent ones of a plurality of spark plugs each provided for one of a plurality of cylinders of an internal combustion engine, comprising:

a case formed from an insulating resin and having two tubular portions integrally formed with said case;

two coil assemblies received in said case;

a cured casing resin filled in each case for sealing and setting said coil assemblies in said case; and wherein each of said two coil assemblies has a primary coil and a secondary coil, and said ignition coil unit further includes a pair of ON-state voltage blocking diodes, each of said diodes being connected between one end of one of said primary coils and a high-tension side of each of said secondary coils.

5. An ignition coil unit for being directly connected to two adjacent ones of a plurality of spark plugs each provided for one of a plurality of cylinders of an internal combustion engine, comprising:

a case formed from an insulating resin and having two tubular portions integrally formed with said case;

two coil assemblies received in said case;

a cured casing resin filled in each case for sealing and setting said coil assemblies in said case; and wherein each of said two coil assemblies has a primary coil and a secondary coil, said secondary coils having low-tension sides connected together at a common junction, and said ignition coil unit further includes an ON-state voltage blocking diode connected between one end of one of said primary coils and said common junction between the respective low-tension sides of said secondary coils.

6. An ignition coil unit for being directly connected to two adjacent ones of a plurality of spark plugs each provided for one of a plurality of cylinders of an internal combustion engine, comprising:

a pair of coil assemblies each including a closed magnetic circuit core and a primary coil and a secondary coil that are magnetically connected with each other via said closed magnetic circuit core;

a case made from an insulating resin and receiving therein said pair of coil assemblies in longitudinally aligned relation, said case including a pair of bulged portions formed integrally with opposite longitudinal end portions of said case, a pair of tubular portions contiguous to forward ends of said bulged portions, respectively, and confronting to the two adjacent spark plugs, and a shallow-bottom portion provided at a central portion of said case and retaining thereon said closed magnetic circuit core;

a pair of high-tension terminals mounted in said tubular portions, respectively, and electrically connected to respective high-tension sides of said secondary coils within said bulged portions; and a cured casing resin filled in said case for sealing and setting said coil assemblies in said case.

7. An ignition coil unit according to claim 6, further including a pair of ON-state voltage blocking diodes, each of said diodes being connected between one end of one of said primary coils and said high-tension side of one of said secondary coils.

8. An ignition coil unit according to claim 6, wherein said secondary coils of said pair of coil assemblies have low-tension sides connected together at a common junction, and said ignition coil unit further includes on ON-state voltage blocking diode connected between one end of one of said primary coils and said common junction between the respective low-tension sides of said secondary coils.

9. An ignition coil unit according to claim 6, wherein said pair of coil assemblies are disposed in opposite relation to one another, with respective low-tension sides of said secondary coils located close to one another.

10. An ignition coil unit according to claim 9, further including a pair of primary connectors located at a central portion of said case and disposed at one side of said primary coils adjacent to said low-tension sides of the respective secondary coils, each of said primary connectors having an engagement portion directed away from the engagement portion of another primary connector and opening in a longitudinal direction of said case.

11. An ignition coil unit according to claim 6, wherein said case has a pair of mounting legs formed integrally with opposite longitudinal ends of said case for mounting said case in the internal combustion engine.

12. An ignition coil unit according to claim 11, wherein said mounting legs are displaced in different directions with respect to a longitudinal central axis of said case.

13. An ignition coil unit according to claim 11, wherein the sum of the length of said case excluding said mounting legs and the length of one of said mounting legs is less than or equal to twice the distance between said pair of high-tension terminals.

* * * * *